US005465917A

United States Patent [19]

Kosch

[11] Patent Number: 5,465,917

[45] Date of Patent: Nov. 14, 1995

[54] WELDING WIRE DISPENSER WITH ADJUSTABLE BRAKE

[76] Inventor: Delmar D. Kosch, 1730 Woodland Dr., Columbus, Nebr. 68601

[21] Appl. No.: 247,859

[22] Filed: May 23, 1994

[51] Int. Cl.[6] ..... B65H 49/00

[52] U.S. Cl. ..... 242/128; 242/156; 242/156.2; 242/361; 242/421

[58] Field of Search ..... 242/128, 156, 242/156.2, 421, 564.3, 361, 171, 172

[56] References Cited

U.S. PATENT DOCUMENTS

| | | | |
|---|---|---|---|
| 1,031,487 | 7/1912 | Taylor | 242/156.2 |
| 2,419,808 | 4/1947 | Wirth | 242/156.2 |
| 3,638,877 | 2/1972 | Clark et al. | 242/128 |
| 4,253,624 | 3/1981 | Colbert | 242/128 |
| 4,423,588 | 1/1984 | Garcia | 242/156.2 |
| 4,456,198 | 6/1984 | Kosch | 242/156.2 |
| 4,465,246 | 8/1984 | Kosch | 242/156.2 |
| 4,508,291 | 4/1985 | Kosch | 242/156.2 |
| 4,602,753 | 7/1986 | Kosch | 242/156.2 |
| 4,681,277 | 7/1987 | Kosch | 242/156.2 |

FOREIGN PATENT DOCUMENTS

| | | | |
|---|---|---|---|
| 1369072 | 8/1963 | France | 242/156.2 |
| 2145237 | 2/1973 | France | 242/128 |
| 2721616 | 11/1978 | Germany | 242/128 |

*Primary Examiner*—Daniel P. Stodola
*Assistant Examiner*—William Stryjewski
*Attorney, Agent, or Firm*—Zarley, McKee, Thomte, Voorhees & Sease; Dennis L. Thomte

[57] ABSTRACT

A welding wire dispenser for use on a spool of welding wire comprising a base which is removably secured to the top plate of the spool. A let-off arm is rotatably mounted on the base and has a guide tube mounted thereon through which the welding wire extends. A brake is provided on the base and is associated with a coil spring to tension or compress the same as the welder or wire feeder pulls the wire from the spool of wire. When the welder or wire feeder discontinues its pulling action on the wire, the tension in the spring exerts sufficient force on the wire extending from the spool to prevent the wire from shingleing.

6 Claims, 3 Drawing Sheets

WELDING WIRE DISPENSER WITH ADJUSTABLE BRAKE

BACKGROUND OF THE INVENTION

In many types of welding operations, a wire feeder feeds welding wire to a welder. The welding wire is normally wound upon coils or reels and is unwound therefrom as wire is being consumed. For example, see my previous patents, namely U.S. Pat. Nos. 4,456,198; 4,465,246; 4,508,291; 4,602,753; and 4,681,277.

In an effort to reduce the costs connected with the manufacture of welding wire dispensers, one or more devices have been previously provided wherein the welding wire dispenser is bolted or otherwise secured to the upper end of the stationary reel. For example, see U.S. Pat. No. 4,253,624 wherein a let-off arm rotates counterclockwise around the coil, releasing one strand of wire per revolution. A problem associated with the let-off devices such as disclosed in U.S. Pat. No. 4,263,624 is that when the wire feeder discontinues its pulling or feeding operation, there is not sufficient force exerted on the welding wire to prevent the welding wire from falling downwardly on the coil or "shingleing" as it is commonly called. Although the let-off arm of U.S. Pat. No. 4,253,624 does have a brake means which yieldably resists the rotation of the let-off arm, there is apparently no means associated therewith which will exert sufficient force on the wire to prevent the shingleing or tangling of the wire.

SUMMARY OF THE INVENTION

A welding wire dispenser is disclosed which dispenses wire to a wire feeder and which is removably mounted on the upper end of a spool or coil of welding wire. The dispenser includes a support base which is removably secured to the upper plate of the wire spool. The support base includes an upstanding and centrally disposed hub having a vertically disposed shaft rotatably mounted therein. An arm is rotatably mounted on the shaft above the hub and extends outwardly therefrom. A flexible U-shaped brake band comprised of urethane or the like has its opposite ends secured to the arm and has its inner U-shaped end received in an annular groove formed in the outer surface of the hub. Means is provided for adjusting the tension in the brake band to create more or less frictional engagement between the brake band and the hub.

A vertically disposed spring is mounted on the shaft above the arm and has its lower end in engagement therewith. A let-off arm is secured to the shaft above the spring and extends outwardly therefrom. A wire guide is secured to the let-off arm for guiding wire from the coil to the wire feeder or welder. The upper end of the spring is operatively connected to the shaft and let-off arm so that rotation of the let-off arm and the shaft in one direction, as wire is being pulled from the spool or coil, will tend to at least partially compress the spring and will cause the shaft to be rotated relative to the hub against the yieldable resistance of the brake band positioned in the annular groove on the hub. When the welding wire feeder or welder discontinues its pulling operation, the spring maintains sufficient tension in the welding wire between the wire guide and the coil so that the coils of wire on the spool will not shingle.

It is therefore a principal object of the invention to provide an improved welding wire dispenser.

A further object of the invention is to provide an improved welding wire dispenser which is removably secured on the upper end of a spool or coil of welding wire.

Yet another object of the invention is to provide a welding wire dispenser which is removably mounted on the upper end of a coil or spool of welding wire and which includes means to prevent shingleing of the coils of wire on the spool when the welder or wire feeder discontinues its pulling or feeding operation.

Yet another object of the invention is to provide a welding wire dispenser which is economical of manufacture and durable in use.

These and other objects will be apparent to those skilled in the art.

DESCRIPTION OF THE PREFERRED EMBODIMENT

Figure 2:
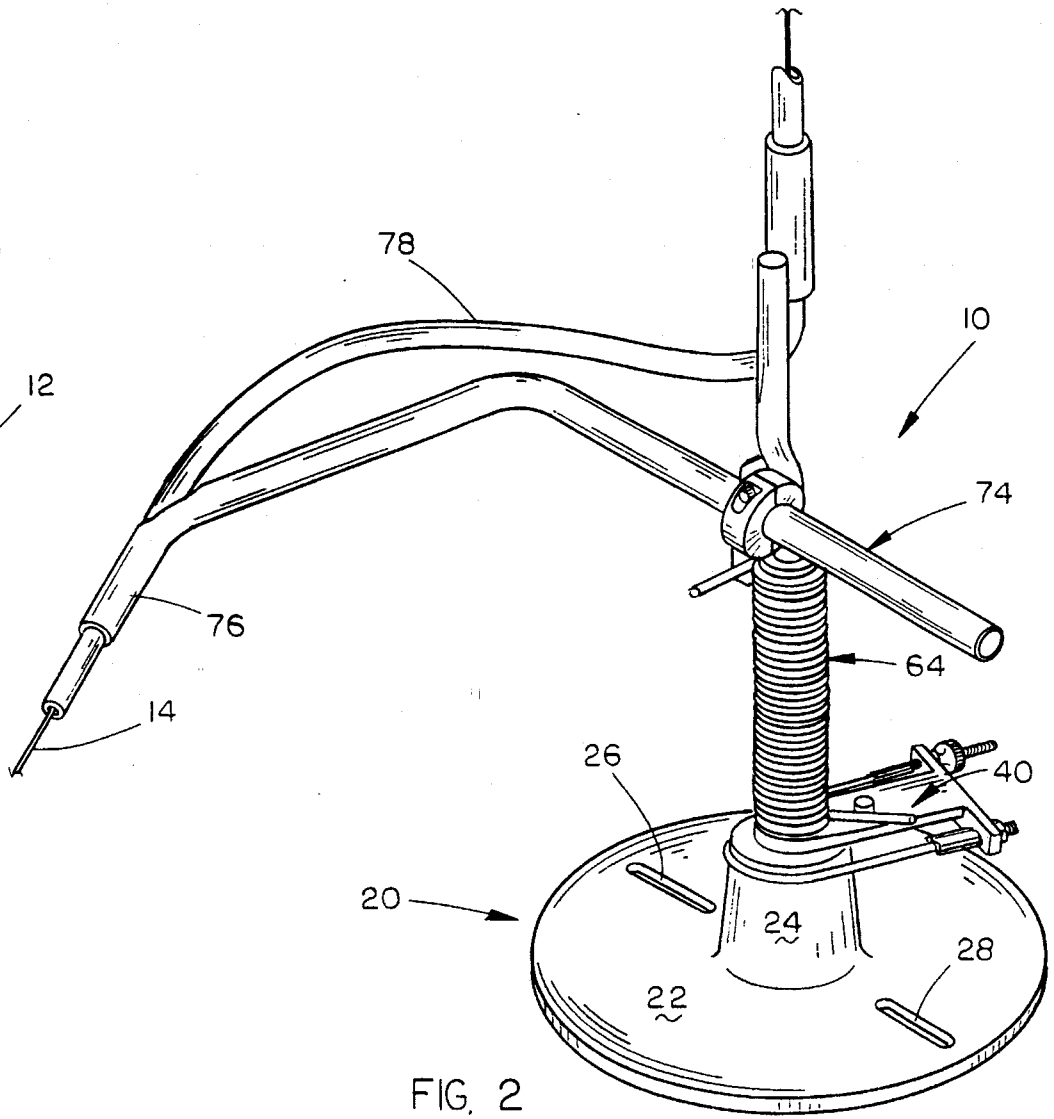
FIG. 2 is a perspective view of the welding wire dispenser of this invention.

The numeral 10 refers to the welding wire dispenser of this invention which is adapted for use with a spool or coil 12 having wire 14 coiled thereon. For purposes of description, spool 12 will be described as having an upper plate 16 and a lower plate 18.

Dispenser 10 includes a pedestal 20 having a base 22 and a hub 24 extending upwardly therefrom. Base 22 is provided with a pair of slots 26 and 28 formed therein adapted to receive J-shaped connectors 30 and 32 respectively which are secured to the upper plate 16 of spool 12 to position pedestal 20 on the spool 12.

Pedestal 20 has a vertically disposed bore 34 extending downwardly therethrough which rotatably receives shaft 36. Hub 24 has an annular groove or recess 38 formed therein which extends therearound as will be described in more detail hereinafter.

Figure 1:
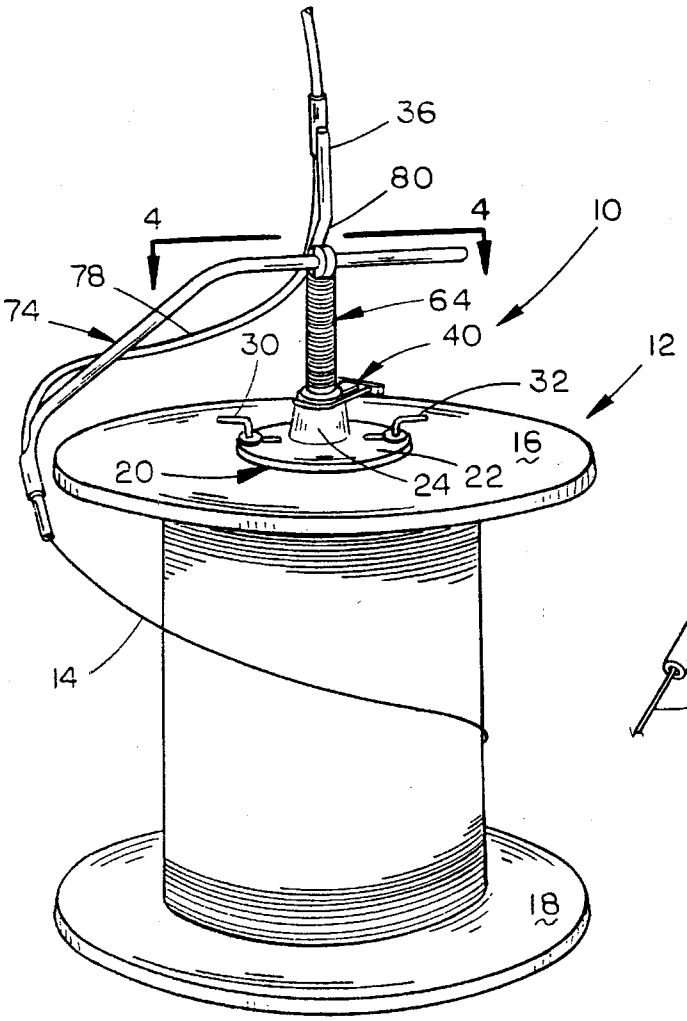
FIG. 1 is a perspective view of the welding wire dispenser of this invention mounted on a spool of wire.
Figure 3:
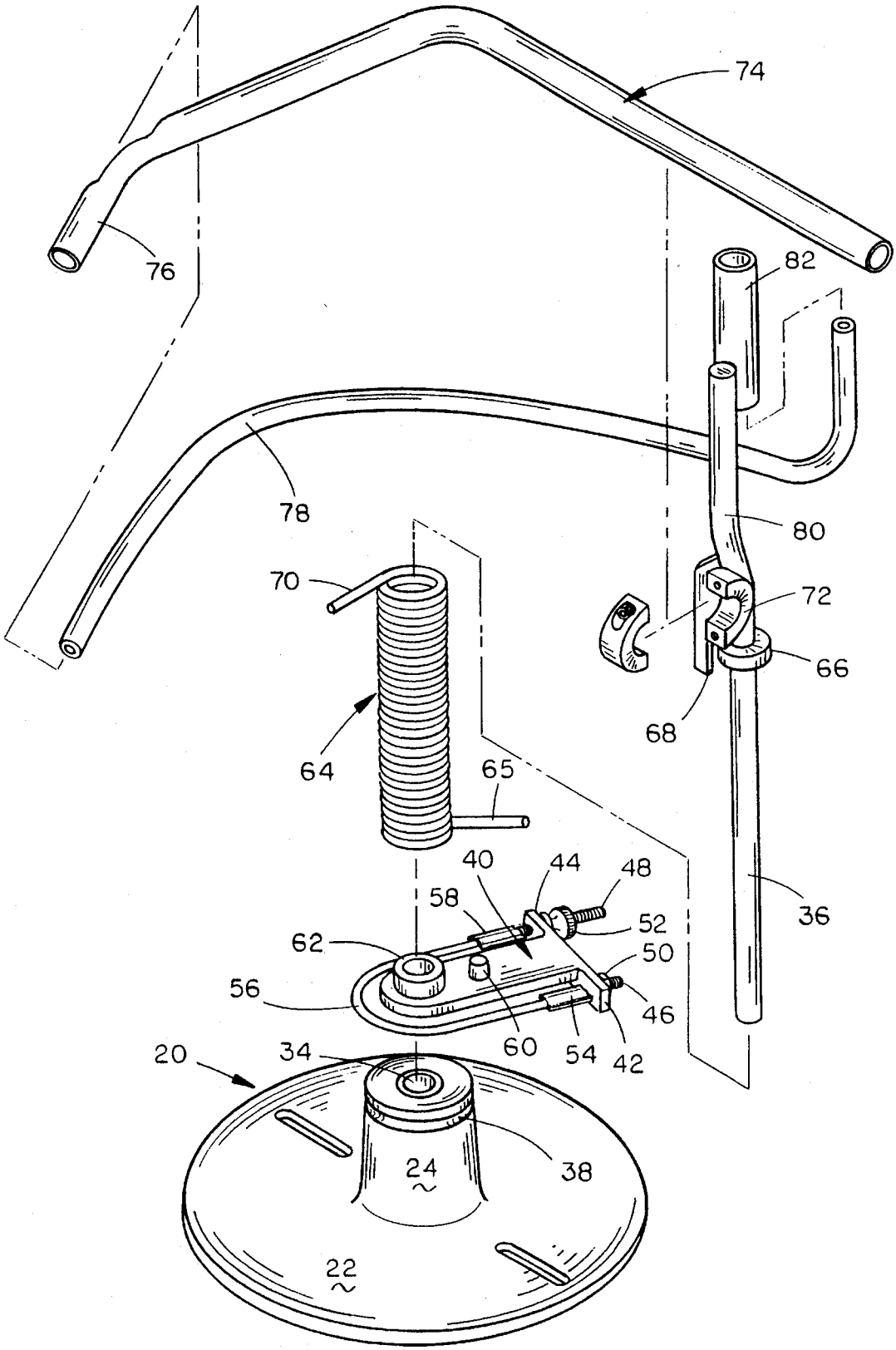
FIG. 3 is an exploded perspective view of the welding wire dispenser of this invention.
Figure 5:
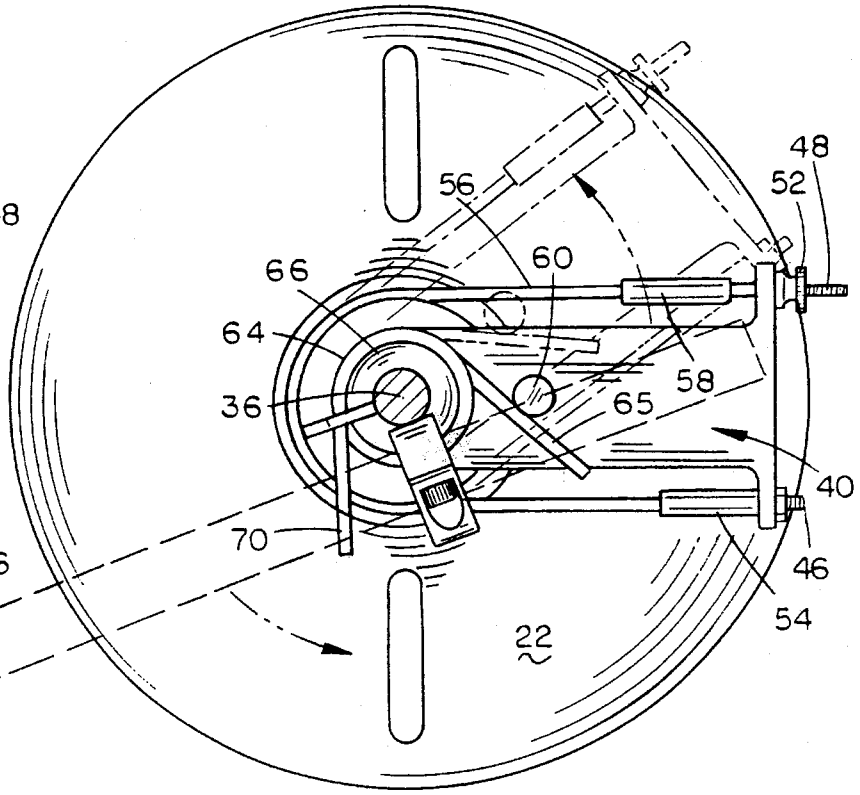
FIG. 5 is a view similar to FIG. 4 except that the welding wire dispenser has rotated with respect to the spool.
Figure 4:
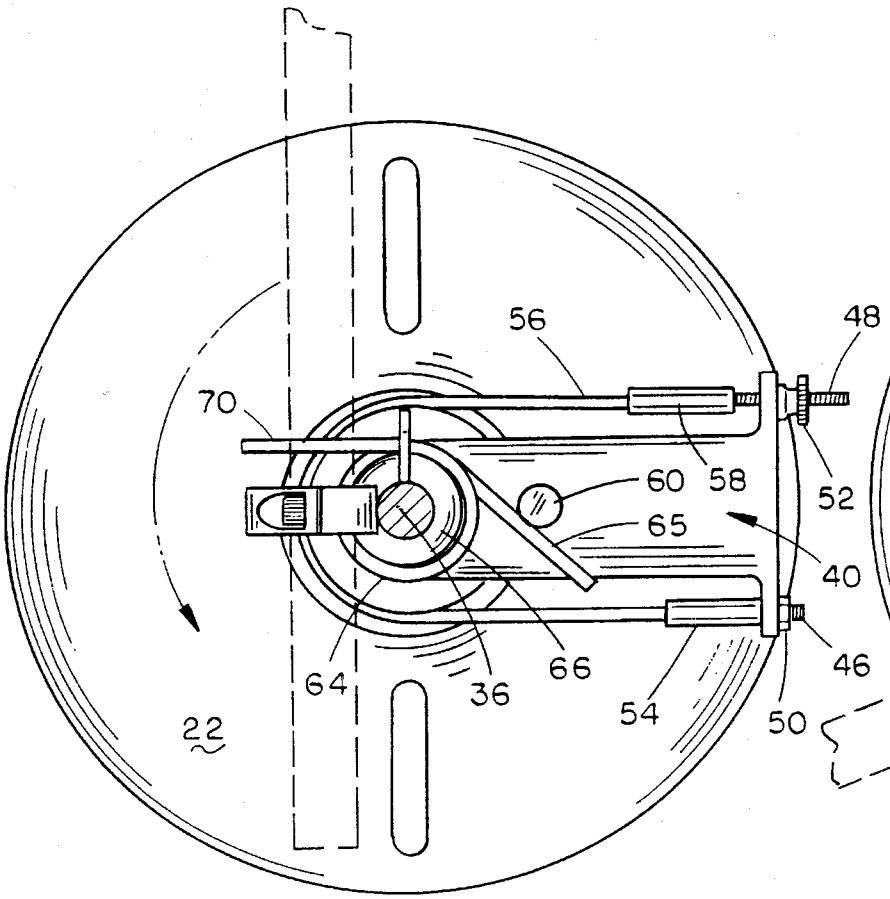
FIG. 4 is a sectional view seen on lines 4—4 of FIG. 1.

Arm 40 has its inner end rotatably mounted on shaft 36 and extends outwardly and downwardly therefrom as illustrated in FIG. 1. The outer end of arm 40 is generally T-shaped and has a pair of outwardly extending shoulders 42 and 44 which have openings formed therein for receiving the ends of threaded studs 46 and 48 therein respectively. Stud 46 has a nut 50 threadably mounted thereon outwardly of shoulder 42 while stud 48 has a tension adjustment knob 52 threadably mounted thereon. Stud 46 has a connector 54 secured to its inner end which is secured to one end of an elongated, flexible brake band 56 preferably comprised of a urethane material. Band 56 is received by the groove 38 and has its other end secured to a connector 58 which is secured to stud 48. Threadable adjustment of knob 52 increases or decreases the frictional or braking engagement between band 56 and groove 38. Arm 40 is also provided with a upstanding finger 60 adjacent its inner end.

Sleeve or collar 62 extends upwardly from arm 40 and has a coil spring 64 mounted thereon. The lower end 65 of coil spring 64 extends outwardly for engagement with finger 60 as illustrated in FIG. 2. Collar 66 is secured to shaft 36 and is partially received by the upper end of spring 64. Collar 66 includes a downwardly extending portion 68 adapted to engage the outwardly extending upper end portion 70 of coil spring 64.

Clamp 72 is welded to shaft 36 above collar 66 and has a let-off arm 74 adjustably received therein. The outer end 76 of arm 74 supports one end of a guide tube 78 therein as seen in FIG. 2. Shaft 36 is provided with an offset portion 80 at its upper end to which is secured a support 82 having the other end of guide tube 78 mounted therein.

As seen in FIG. 1, the wire 14 extends from the coil upwardly through guide tube 78 and thence to the welder or wire feeder. Assuming that band 56 is loosely engaging groove 38 for initial description purposes, as the wire 14 is pulled from the coil by the welder or wire feeder, shaft 36, arm 40, spring 64, support rod 74 and guide tube 78 will freely rotate in a counter-clockwise direction (FIG. 1) with respect to pedestal 20 and with respect to the spool 12.

In such a situation, there would be insufficient tension in the wire 14, when the welder or wire feeder stops pulling the wire 14 from the spool 12, to prevent the coils of the wire 14 from falling downwardly and "shingleing" which will create serious problems in subsequent wire feeding operations.

The shingleing effect is eliminated by properly adjusting adjustment knob 52 to create frictional or braking engagement between band 56 and groove 38. Adjustment knob 52 is sufficiently tightened to draw band 56 into frictional engagement with groove 36 to yieldably resist the rotation of arm 40 with respect to hub 24. As let-off arm 74 and guide tube 78 are rotated with respect to the wire 14 being pulled from the spool 12 by the welder or wire feeder, the upper end of coil spring 64 is moved with respect to the lower end thereof since arm 40 is being yieldably held in position by the band 56, to tighten or compress the spring 64. The frictional or braking engagement of the arm 40 by the band 56 ensures that the spring 64 will always be slightly tensioned even though the band 56 moves within groove 36. When the welder or wire feeder discontinues its pulling action on the wire 14, the tension in the spring 64 prevents the coils of the wire 14 from falling downwardly or shingleing on the spool since the wire 14 between the spool 12 and the lower end of the guide tube 78 will be yieldably urged away from the wire unwinding direction.

Thus it can be seen that the invention accomplishes at least all of its stated objectives.

I claim:

1. A welding wire dispenser for dispensing welding wire wound upon a welding wire spool to a welder, said welding wire spool having an upper plate, comprising:

a support base secured to said upper plate of said spool and including an upstanding hub;

a vertically disposed shaft having its lower end rotatably mounted in said hub;

an arm having inner and outer ends;

said arm having its inner end rotatably mounted on said shaft above said hub and extending outwardly therefrom;

a brake operatively interconnecting said arm and said hub for yieldably resisting the rotation of said arm with respect to said hub;

a spring mounted on said shaft and having upper and lower ends;

the lower end of said spring being in operative engagement with said arm wherein rotational movement of said shaft in one direction will cause said lower end of said spring means to rotate said arm in said one direction against the yieldable resistance of said brake;

a let-off arm secured to said shaft for rotation therewith;

said let-off arm extending outwardly from said shaft;

said let-off arm rotating with respect to said hub in one direction as the welding wire is pulled from the spool;

a welding wire guide secured to said let-off arm for guiding the wire being pulled from the welding wire spool;

the upper end of said spring being operatively secured to said let-off arm whereby the rotation of said let-off arm in said one direction, as welding wire is pulled from the spool, will cause said spring to be at least partially compressed against the yieldable resistance of said brake, so that said spring will maintain tension in the welding wire between said welding wire guide and the spool so that the coils of wire on the spool will not shingle when the pulling force on the welding wire is discontinued.

2. The welding wire dispenser of claim 1 wherein the braking force of said brake is manually adjustable.

3. The welding wire dispenser of claim 1 wherein said brake comprises an elongated, flexible member wrapped around said hub and having its opposite ends secured to said outer end of said arm.

4. The welding wire dispenser of claim 3 wherein said elongated, flexible member frictionally engages said hub and wherein adjustment means is provided for adjusting the frictional engagement of said elongated, flexible member with respect to said hub.

5. The welding wire dispenser of claim 3 wherein said hub has an annular groove formed therein and wherein said elongated, flexible member is received in said annular groove.

6. The welding wire dispenser of claim 1 wherein said brake comprises a manually adjustable brake band which is partially wrapped around said hub for adjusting force of said brake.

* * * * *